United States Patent [19]

Grasse et al.

[11] Patent Number: 4,538,629

[45] Date of Patent: Sep. 3, 1985

[54] METHOD AND APPARATUS FOR THE PRODUCTION AND MANIPULATION OF PLAIN CIGARETTES AND THE LIKE

[75] Inventors: Hans-Jochen Grasse, Wentorf; Rolf Gömann, Dassendorf, both of Fed. Rep. of Germany

[73] Assignee: Hauni-Werke Körber & Co. KG., Hamburg, Fed. Rep. of Germany

[21] Appl. No.: 510,406

[22] Filed: Jul. 1, 1983

[30] Foreign Application Priority Data

Jul. 3, 1982 [DE] Fed. Rep. of Germany ..... 3224897

[51] Int. Cl.[3] ..... A24C 5/32

[52] U.S. Cl. ..... 131/282

[58] Field of Search ..... 131/281, 282, 84 R

[56] References Cited

U.S. PATENT DOCUMENTS

| | | | |
|---|---|---|---|
| 3,000,488 | 9/1961 | Rowlands | 131/282 |
| 3,625,103 | 12/1971 | Giatti | 131/282 |
| 3,812,950 | 5/1974 | Rudszinat . | |
| 3,951,267 | 4/1976 | Reuland | 209/73 |
| 3,999,134 | 12/1976 | Lorenzen | 131/282 |
| 4,051,947 | 10/1977 | Schumacher | 198/478 |
| 4,177,670 | 12/1979 | Heitmann et al. | 73/38 |
| 4,185,644 | 1/1980 | Heitmann et al. | 131/282 |
| 4,189,045 | 2/1980 | Verjux | 198/457 |
| 4,291,713 | 9/1981 | Frank | 131/68 |

FOREIGN PATENT DOCUMENTS

| | | | |
|---|---|---|---|
| 0361079 | 10/1922 | Fed. Rep. of Germany | 131/282 |
| 0367675 | 1/1923 | Fed. Rep. of Germany | 131/282 |

*Primary Examiner*—V. Millin

*Attorney, Agent, or Firm*—Peter K. Kontler

[57] ABSTRACT

The cigarette rod which is produced in a cigarette maker is subdivided into a file of plain cigarettes of unit length or double unit length. If the file contains cigarettes of unit length, successive pairs of cigarettes are deflected sideways to form two rows of coaxial cigarettes before the cigarettes of one row are staggered transversely of the cigarettes of the other row so that the two rows can be converted into a single row by shifting the cigarettes of at least one row axially between the neighboring cigarettes of the other row. If the file contains cigarettes of double unit length, such file is converted into a single row of parallel cigarettes which are thereupon severed to yield pairs of coaxial cigarettes of unit length forming two rows wherein each cigarette of one row is coaxial with a cigarette of the other row. The cigarettes of one row are then staggered with reference to the cigarettes of the other row prior to shuffling to form a single row of parallel cigarettes of unit length. The cigarette paper web which is draped around a tobacco filler to form therewith the rod is imprinted at intervals corresponding to the length of a plain cigarette of unit length.

22 Claims, 6 Drawing Figures

METHOD AND APPARATUS FOR THE PRODUCTION AND MANIPULATION OF PLAIN CIGARETTES AND THE LIKE

BACKGROUND OF THE INVENTION

The present invention relates to a method and apparatus for the production and manipulation of plain cigarettes or analogous rod-shaped articles of unit length which constitute or form part of smokers' products. More particularly, the invention relates to improvements in a method and in an apparatus for converting a continuous wrapped filler rod into a succession of discrete rod-shaped articles or sections of prescribed length.

It is already known to repeatedly sever the leader of a continuous cigarette rod which is produced in a cigarette rod making machine so that the rod yields a single file of discrete plain cigarettes of unit length. It is also known to convert such file of cigarettes into a row wherein the cigarettes move sideways (i.e., at right angles to their respective axes) and to deliver the thus obtained row to storage, to a packing machine or to a filter tipping machine wherein the cigarettes are united with filters to form filter cigarettes of unit length or multiple unit length. The procedure is or can be similar in connection with the production of plain or filter tipped cigarillos or cigars. For the sake of simplicity, the following discussion of the state of art will deal with the production and manipulation of cigarettes.

In accordance with other prior proposals, the cigarette rod is converted into a file of plain cigarettes of multiple unit length. Such cigarettes of multiple unit length are thereupon caused to form a row and are subdivided into cigarettes of unit length subsequent to formation of the row. Reference may be had to German Pat. No. 361,079 to Creuzburg. If the nature of the cigarettes demands that one or more cigarettes of unit length which are obtained by severing successive cigarettes of multiple unit length must be tip turned, such tip turning (inversion through 180 degrees) is effected in such a way that the inverted cigarettes are placed on top of or between the non-inverted cigarettes. Reference may be had to U.S. Pat. No. 3,000,488 to Rowlands. For example, such tip turning of one row is necessary if the cigarettes of unit length form two rows and the nature or positioning of imprints on the wrappers of cigarettes is such that the orientation of imprints on all cigarettes of a cigarette pack is the same only if the cigarettes of one row are tip turned prior to merging them with the cigarettes of the other row. Tip turning is also necessary if the articles are mouthpiece cigarettes. A drawback of tip turning is that it subjects the respective cigarettes to pronounced mechanical stresses and invariably entails at least some losses of tobacco at the ends. Moreover, tip turning can slow down the processing or manipulation of cigarettes and can cause contamination of their wrappers. Problems in connection with tip turning are particularly acute when the cigarettes are produced at a high speed, e.g., in excess of 7000 per minute which is the expected minimum output of a modern high-speed cigarette rod making machine. At such elevated speeds, losses in tobacco at the ends of plain cigarettes can be quite pronounced, even if the cigarettes are manufactured with so-called dense ends. The particles of tobacco which escape at the ends of cigarettes not only cause a reduction of the quality of the ultimate products but they also contaminate the machine and the surrounding area.

OBJECTS AND SUMMARY OF THE INVENTION

An object of the invention is to provide a novel and improved method of producing and manipulating plain cigarettes of unit length or analogous smokers' products in such a way that the manipulation need not involve tip turning.

Another object of the invention is to provide a method which renders it possible to mass produce cigarettes or analogous rod-shaped articles and to thereupon manipulate such articles preparatory to and during transport to storage, to a packing machine or to a filter tipping machine without pronounced mechanical or other stressing of the wrappers and/or fillers of such commodities.

A further object of the invention is to provide a method of the above outlined character which can be resorted to for the production and manipulation of plain cigarettes at the rate at which such commodities are turned out by the recent types of mass producing rod making machines.

An additional object of the invention is to provide a method which can be resorted to for rapid conversion of a continuous cigarette rod into a single row of parallel cigarettes of unit length wherein the cigarettes are ready for packing, storage or other forms of further processing.

Another object of the invention is to provide a method which can ensure the formation of such single row without resort to tip turning or analogous devices which are likely to create bottlenecks in a production line including one or more makers of cigarettes, one or more filter tipping machines, one or more filter rod making machines and one or more packing machines.

Still another object of the invention is to provide a novel and improved apparatus for the practice of the above outlined method and to construct and assemble the apparatus in such a way that it can treat the articles gently, without losses of tobacco and in a small area.

A further object of the invention is to provide the apparatus with novel and improved means for converting a continuous wrapped filter rod into a single row of parallel rod-shaped articles of unit length.

Another object of the invention is to provide the apparatus with novel and improved means for converting several rows of rod-shaped articles of unit length into a single row without tip turning of articles in any of the rows.

An additional object of the invention is to provide the apparatus with a novel and improved device for shuffling several rows of parallel rod-shaped articles without any changes in orientation of such articles.

Still another object of the invention is to provide an apparatus which embodies some or all of the above outlined features and which can be incorporated in or assembled with presently known makers of plain cigarettes, cigars, cigarillos or analogous rod-shaped articles constituting or forming part of smokers' products.

A further object of the invention is to provide an apparatus of the above outlined character which reduces the space requirements and the complexity of, the rate of contamination of, the percentage of lost tobacco in and/or number of rejects in production lines for the making and processing of plain or filter tipped rod-shaped smokers' products.

One feature of the invention resides in the provision of a method of producing plain cigarettes or analogous rod-shaped articles of unit length which constitute or form part of smokers' products. The method comprises the steps of forming a continuous rod including draping a web of cigarette paper or other suitable wrapping material around a rod-like filler consisting of tobacco or the like, advancing the rod axially, subdividing the advancing rod into a file of at least substantially coaxial sections of n times unit length wherein n is a whole number including one, converting the file into a plurality of rows of at least substantially parallel sections and advancing the rows so that their sections move sideways (namely, at least substantially at right angles to the axes of the sections), and shuffling the sections of the plurality of rows so as to convert such rows into a single row of parallel or nearly parallel sections. The converting step or a discrete additional step can comprise staggering the sections of the plurality of rows with reference to each other, as considered at right angles to the axes of the sections which form the rows, prior to the shuffling step so that the staggered sections of the plurality of rows are out of axial alignment with each other. This renders it possible to shuffle the sections of the several rows by the simple expedient of shifting the sections of one or more rows axially between the neighboring sections of the other row or rows.

If n exceeds one, the converting step preferably comprises changing the direction of movement of the sections (of multiple unit length) of the file from axial to sidewise movement so that the sections of multiple unit length form a single row wherein the sections of multiple unit length move sideways, subdividing the sections of multiple unit length which form the single row into articles of unit length so that the single row of sections of multiple unit length yields n rows of articles of unit length wherein each article of one of the n rows is in axial alignment with an article of each other row, and staggering the articles of any one of the n rows of articles out of axial alignment with the articles of each other row. In accordance with a presently preferred embodiment of the just outlined method, n equals two.

If n equals one, the converting step preferably comprises substantially simultaneously changing the direction of advancement of successive groups of m sections of the file so that the groups of sections form m rows of parallel sections, moving the sections of the m rows sideways so that each section of one of the m rows is in axial alignment with one section of each other row, and staggering the sections of the m rows relative to each other so that the sections of any one of the m rows are out of axial alignment with the sections of each other row prior to the shuffling step. In accordance with a presently preferred embodiment of the just outlined method, m equals two.

The method can further comprise the step of applying to the web of wrapping material indicia at regular intervals corresponding to the length of an article of unit length. Such indicia applying step can precede the draping of the web around the filler and can involve the imprinting of the name of the manufacturer, the trademark(s) of the manufacturer, the brand name of the manufacturer or a combination of such information. The indicia applying step renders it unnecessary to invert one or more rows of sections prior to or during shuffling.

Another feature of the invention resides in the provision of an apparatus for producing plain cigarettes or analogous rod-shaped articles of unit length which constitute or form part of smokers' products. The apparatus comprises means for forming a continuous rod wherein a rod-like filler is surrounded by a web of cigarette paper or other suitable wrapping material, means for moving the rod axially, means for subdividing the rod into a file of at least substantially coaxial sections of n times unit length wherein n is a whole number including one, means for converting the file into several rows of parallel or substantially parallel sections and for moving the rows along predetermined paths wherein the sections extend at least substantially at right angles to the direction of movement of the respective rows, and means for shuffling the rows to convert them into a single row of at least substantially parallel sections. The shuffling means preferably comrpises means for moving the sections of at least one of the several rows axially.

The converting means can comprises means for maintaining each section of one of the several rows of sections in a position of at least substantial axial alignment with a section of each other row, and such apparatus can further comprise means for staggering the sections of the several rows so that each section of any one of the several rows is out of axial alignment with the sections of each other row prior to treatment of the sections in the shuffling means.

If the subdividing means is designed to subdivide the rod into a file of coaxial sections of multiple unit length, the converting means preferably comprises means for changing the direction of movement of such sections of multiple unit length so that the sections form a single row of sections of multiple unit length, means for severing the sections of multiple unit length which form the single row so that each such section yields n coaxial articles of unit length and such articles of unit length form n rows of parallel articles wherein each article of one of the n rows is in at least substantial axial alignment with an article of each other row, and means for staggering the articles of each of the n rows with reference to the articles of each other row prior to shuffling of the articles by the shuffling means (if n equals two, it suffices to stagger the articles of one of the two rows with reference to the articles of the other row so that the articles of the one and/or other row can be moved one behind the other and together form a single row of articles of unit length).

If n equals one, the converting means can comprise means for changing the direction of movement of successive groups of m sections (e.g., two consecutive sections) from axial to sidewise movement so that the groups form m rows of parallel sections (i.e., articles of unit length) wherein each section of one of the m rows is in axial alignment with one section of each other row, and means for staggering each section of one of the m rows with reference to each section of each other row prior to shuffling of the sections by the shuffling means.

The apparatus can further comprise means for imprinting indicia upon the web of wrapping material at intervals corresponding to the length of an article of unit length.

The shuffling means can comprise an endless conveyor having several sets of flutes or analogous article receiving means, one set for each of the several rows, and means for moving the receiving means of at least one set in the axial direction of the articles or sections therein. The conveyor can comprise or constitute a rotary drum and the receiving means are then disposed at the periphery of the drum. The receiving means of at least one of the sets is movable in parallelism with the axis of the drum. The latter can be provided with axially parallel peripheral recesses, one for each article receiving means, and the moving means can comprise means for shifting the receiving means of at least one of the several sets in the respective recesses from one axial end toward the center of the drum. If the number of sets is two, the receiving means of one of the sets alternate with the receiving means of the other set and the moving means preferably further comprises means for moving the receiving means of the other set from the other axial end toward the center of the drum and vice versa so that the articles in the receiving means of one of the sets overlap (i.e., lie behind) the articles in the other set of receiving means when the receiving means of the two sets are moved to the center of the drum. Such moving means can comprise cam means.

Alternatively, the shuffling means can comprise an endless conveyor, several sets of carriers provided on the conveyor, at least two article-receiving means provided on each carrier, and means for moving the carriers of at least one set with reference to the carriers of each other set in the axial direction of articles in the receiving means. The sets of carriers can include a first and a second set, and the receiving means on the carriers of the first set are staggered with reference to the receiving means on the carriers of the second set, as considered at right angles to the axes of articles or sections in the receiving means, by a distance at least matching the width of a receiving means. The moving means of such shuffling means can comprise cam and follower means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
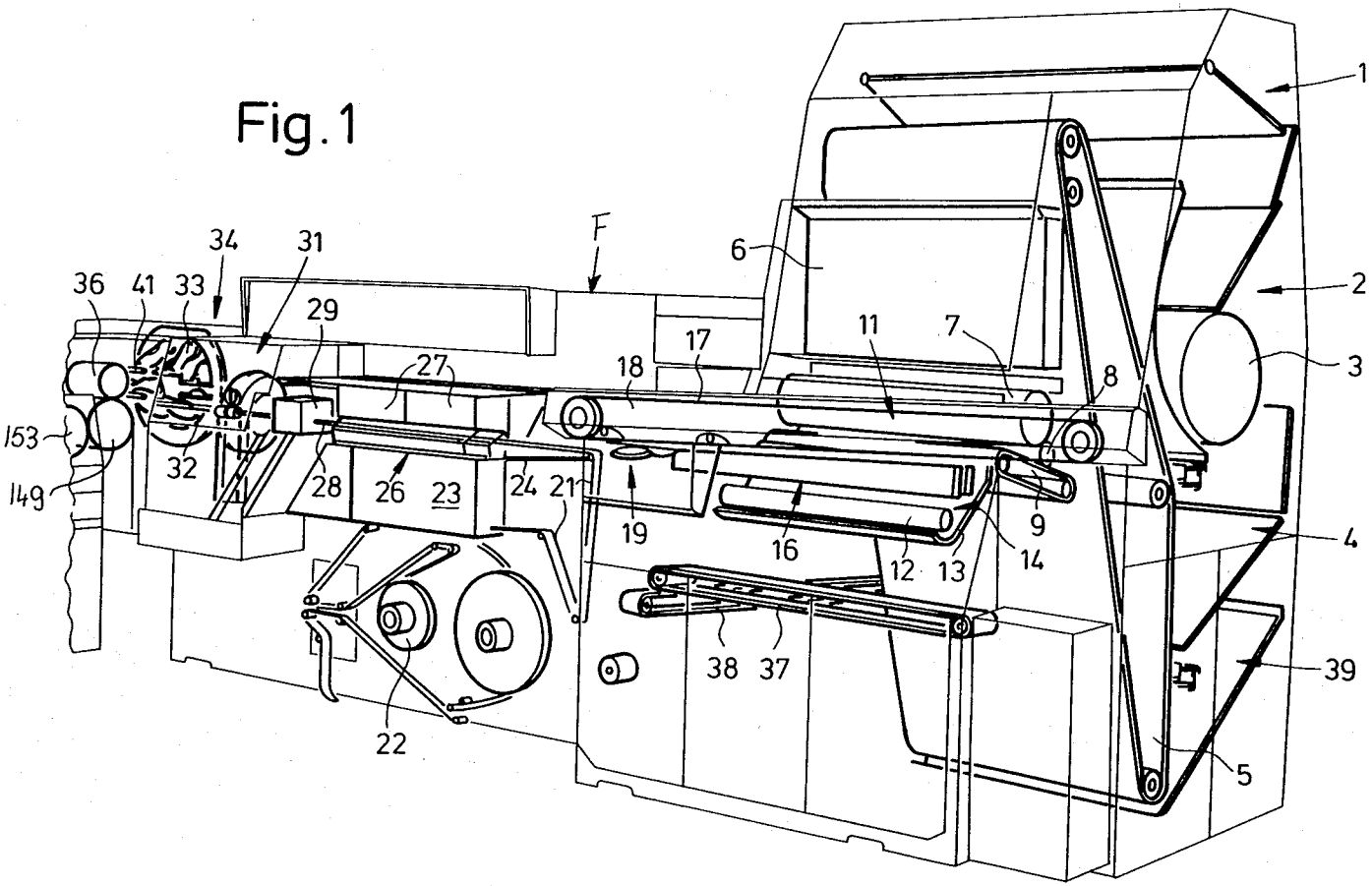
FIG. 1 is a somewhat schematic perspective view of a cigarette rod making machine including an apparatus which embodies one form of the present invention.

Referring first to FIG. 1, there is shown a cigarette rod making machine of the type known as PROTOS (manufactured by the assignee of the present application). This machine comprises a frame or housing F containing a pivotable gate 1 serving to admit batches of tobacco particles (mainly tobacco shreds) into a primary distributor 2. A roller-shaped withdrawing element 3 serves to transfer tobacco particles (when needed) into a magazine 4 which is adjacent to an upwardly advancing reach of a steep endless belt conveyor 5 of the type disclosed in commonly owned U.S. Pat. No. 4,185,644 granted Jan. 29, 1980 to Heitmann et al. The conveyor 5 is provided with pockets which serve to transport metered or substantially metered quantities of tobacco particles from the magazine 4 into a substantially upright duct 6 the lower end portion of which is adjacent to the top portion of a driven rotary carded drum 7 serving to draw tobacco particles at a constant rate from the duct 6 and into the range of teeth on a rapidly driven picker roller 8. The roller 8 expels the particles of tobacco from the carding of the drum 7 and propels the expelled particles onto the upper reach of a wide apron conveyor 9 which is driven at a constant speed and whereon the particles form a wide carpet. The particles which reach and advance beyond the discharge end of the apron conveyor 9 are in the range of a classifying unit 11 defining an upright curtain of compressed air which is traversed by heavier and/or larger particles (such as fragments of ribs, birds' eyes and the like) but deflects the lighter particles into a funnel 14 defined in part by a downwardly sloping wall 13 and in part by a carded roller 12. The carding of the roller 12 propels the particles of tobacco from below into an elongated channel 16 the upper end of which is closed by the lower reach of an elongated foraminous tobacco transporting belt conveyor 17. The lower reach of this conveyor travels below the underside of a stationary suction chamber 18 so that the lower reach gathers a growing tobacco stream which is transported in a direction to the left, as viewed in FIG. 1. Successive increments of the fully grown tobacco stream at the underside of the lower reach of the conveyor 17 are transported past a trimming or equalizing device 19 which removes the surplus from the fully grown tobacco stream so that the latter is converted into a trimmed stream of constant height and width. The trimmed stream is transferred onto the upper reach of an endless belt conveyor 24, and more particularly onto the upper side of a web 21 of cigarette paper which is drawn from a bobbin 22 and is caused to pass through an imprinting mechanism 23 on its way toward and onto the upper side of the upper reach of the conveyor 24. The latter is driven to advance the web 21 and the trimmed tobacco stream thereon in a direction toward, through and beyond a combined condensing and draping or wrapping mechanism 26 wherein the web 21 is draped around the trimmed tobacco stream and the latter is simultaneously compacted so that it forms the rod-like filler of a continuous cigarette rod 28. The conversion of the web 21 and trimmed tobacco stream into the rod 28 is effected in two stages the first of which involves compacting of the trimmed stream and the draping of the web 21 therearound so that one marginal portion of the draped web extends substantially tangentially of and away from the rod-shaped filler and into the range of a suitable paster (not specifically shown). The paster applies a film of adhesive to one side of the one marginal portion of the web 21 (or activates a previously applied film of adhesive, e.g., a hot melt). The second stage of conversion thereupon involves folding the adhesive-coated marginal portion over the other marginal portion so that the two marginal portions form a seam extending in parallelism with the axis of the rod 28, and heating the seam by a sealer 27, e.g., a tandem sealer of the type disclosed in commonly owned U.S. Pat. No. 4,291,713 granted Sep. 29, 1981 to Frank. This patent also shows a paster.

The conveyor 24 advances the cigarette rod 28 axially into the range of a cutoff 31 serving as a means for subdividing the rod 28 into a single file of discrete rod-shaped sections 32 of double unit length, i.e., each section 32 can yield two plain cigarettes of unit length. A density monitoring device 29 is installed in the frame F ahead of the cutoff 31 to monitor the density of successive increments of the filler of the rod 28 and to control the operation of the trimming device 19 in a manner as disclosed, for example, in commonly owned U.S. Pat. No. 3,999,134 granted Dec. 21, 1976 to Lorenzen.

Successive sections 32 of double unit length advance into the range of successive mobile arms 33 of a transfer device 34 which transfers successive sections into successive axially parallel peripheral flutes of a drum-shaped rotary row forming conveyor 36 whereon the sections 32 form a single row of parallel sections moving sideways, i.e., at right angles to their respective axes.

The cigarette rod making machine of FIG. 1 further comprises endless belt conveyors 37 and 38 which serve to deliver the surplus of tobacco from the trimming device 19 into a magazine 39 mounted in the frame F at a level below the magazine 4 and adjacent to the upwardly moving reach of the conveyor 5. The latter removes portions of returned tobacco prior to removal of tobacco from the magazine 4 so that each pocket of the conveyor 5 transports a composite portion including a certain amount of tobacco particles which were removed from the fully grown stream by the trimming device 19 and a larger amount of non-comminuted particles which are stored in the magazine 4.

The transfer device 34 of FIG. 1 is or can be constructed and assembled in a manner as disclosed in commonly owned U.S. Pat. No. 4,051,947 granted Oct. 4, 1977 to Schumacher et al. This transfer device comprises holders or arms 41 which are caused to travel along an elliptical path and each of which can carry a single section 32 of double unit length or a pair of coaxial plain cigarettes of unit length, depending on the setting of the cutoff 31, i.e., whether the cutoff subdivides the leader of the advancing rod 28 into a single file of sections 32 of double unit length or into a single file of successive groups or pairs of cigarettes of unit length. It can be said that the transfer device 34 constitutes a means for changing the direction of movement of successive sections 32 (or of successive groups of sections of unit length) from axial movement to a movement at right angles to the axes of the respective sections (with the row forming conveyor 36).

Figure 2:
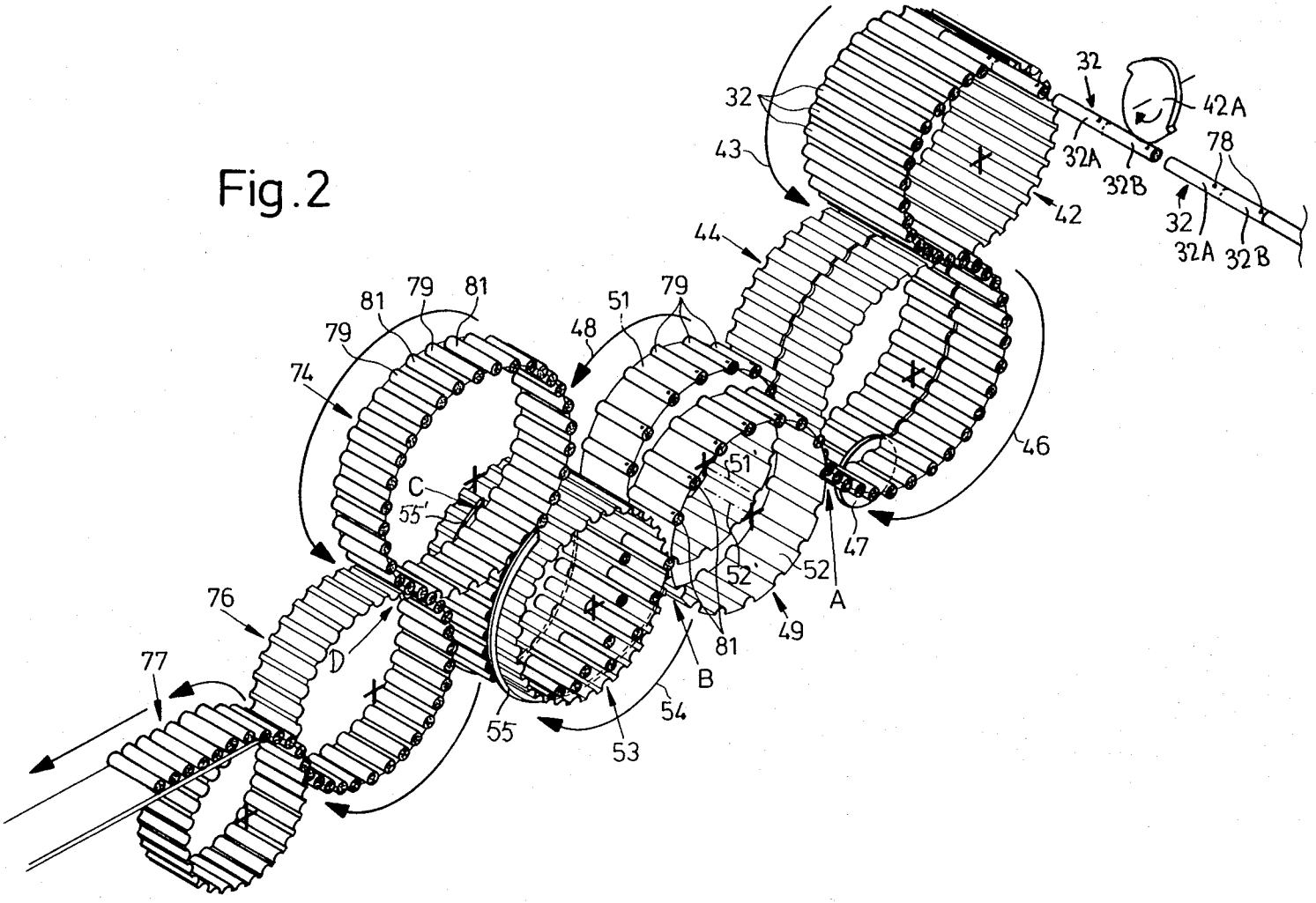
FIG. 2 is an enlarged perspective view of certain components of a second apparatus.

The transfer device 34 of FIG. 1 can be replaced with a transfer device of the type disclosed in German Pat. No. 367,675 granted Jan. 25, 1923 to Creuzburg. This German patent discloses a system wherein cigarettes of three times unit length are moved axially into successive flutes of a rotating drum-shaped conveyor which advances the cigarettes past two rotary disc-shaped knives serving to subdivide each section into three coaxial sections of unit length, i.e., into three discrete plain cigarettes of unit length. A somewhat similar transfer device is disclosed in U.S. Pat. No. 4,189,045 granted Feb. 19, 1980 to Verjux. FIG. 2 of his patent shows that the cigarettes are moved axially into successive axially parallel flutes of a drum-shaped row forming conveyor.

FIG. 2 shows certain components of an apparatus which constitutes a modification of the apparatus shown in the left-hand portion of FIG. 1. The cutoff 31 is assumed to subdivide the leader of the continuous cigarette rod 28 into a single file of rod-shaped sections 32 of double unit length. Successive sections 32 of the file are caused to advance along a suitable guide (not shown in FIG. 2) and are accelerated by the lobes of a rapidly rotating disc cam 42A or an analogous accelerating device so that successive sections 32 enter successive axially parallel flutes at the periphery of an endless drum-shaped rotary row forming conveyor 42 corresponding to the conveyor 36 of FIG. 1. The direction in which the row forming conveyor 42 is driven by the main prime mover (not shown) of the cigarette rod making machine is indicated by the arrow 43.

The row forming conveyor 42 delivers successive sections 32 of double unit length into successive axially parallel peripheral flutes of a drum-shaped severing conveyor 44 which is driven to rotate in the direction indicated by arrow 46 and advances successive sections 32 past a rotary disc shaped knife 47 so that each such section yields a pair of coaxial sections or plain cigarettes 79, 81 of unit length.

The severing conveyor 44 delivers pairs of coaxial cigarettes 79, 81 onto the respective disc-shaped components 51 and 52 of a staggering conveyor 49 whose components rotate in the direction indicated by arrow 48. The cigarettes 79 form a first row of parallel cigarettes, and the cigarettes 81 form a second row each cigarette of which is parallel to a cigarette of the first row. The components 51 and 52 have axially parallel peripheral flutes or other forms of receiving means for the respective rows of plain cigarettes 79 and 81. The arrangement is such that the components 51, 52 transport the cigarettes 79, 81 of the respective rows at different speeds and/or through different distances prior to transfer into successive peripheral flutes of a rotary drum-shaped shuffling conveyor 53 which is driven to rotate in the direction of arrow 54. The manner in which the components 51, 52 of the staggering conveyor 49 convert the two rows of cigarettes 79, 81 into two rows wherein the cigarettes 79 are staggered with reference to the cigarettes 81, as considered in the direction of travel of the two rows, is similar or analogous to that disclosed in commonly owned U.S. Pat. No. 3,228,512 granted January 11, 1966 to Rudszinat et al. In the embodiment of FIG. 2, the axes 51' and 52' of the components 51 and 52 are parallel with but offset relative to each other to thus ensure that successive flutes of the shuffling conveyor 53 contain alternating plain cigarettes 79 and 81. The transfer station where the components 51, 52 of the staggering conveyor 49 receive cigarettes 79, 81 from the severing conveyor 44 is shown at A, and the transfer station where the components 51, 52 deliver cigarettes 79, 81 into alternate flutes of the shuffling conveyor 53 is shown at B.

The shuffling conveyor 53 cooperates with two stationary arcuate condensing cams 55 and 55' which are adjacent to the outer ends of the respective cigarettes 81, 79 and cause such cigarettes to move axially from the respective end portions toward the centers of the corresponding peripheral flutes of the conveyor 53. This results in conversion of the two rows of cigarettes 79, 81 into a single row wherein the cigarettes 79 alternate with the cigarettes 81 and the cigarettes 79, 81 are disposed one behind the other. The cams 55 and 55' converge toward each other in the direction of travel of cigarettes 79, 81 from the transfer station B toward a third transfer station C where the cigarettes 79 and 81

(which by then form a single row) leave the shuffling conveyor 53 to enter successive axially parallel peripheral flutes of a first rotary drum-shaped testing conveyor 74. The distance between the cams 55, 55' at the station B equals or exceeds the combined axial length of a pair of cigarettes 79, 81, and such distance is reduced to that matching the length of a single cigarette 79 or 81 at or even slightly ahead of the transfer station C.

The conveyor 74 can form part of a first testing unit which monitors the wrappers of successive cigarettes 79, 81 and generates defect signals in response to detection of open seams, frayed ends, holes and/or combinations of such defects. The signals are used to segregate the respective cigarettes 79 or 81 from the remaining cigarettes not later than immediately prior to entry of cigarettes into the next processing station, e.g., into a packing machine, not shown. Reference may be had to commonly owned U.S. Pat. No. 4,177,670 granted Dec. 11, 1979 to Heitmann et al.

Cigarettes 79 and 81 which leave the testing conveyor 74 at a fourth transfer station D are accepted by successive axially parallel peripheral flutes of a second rotary drum-shaped testing conveyor 76. The latter can examine the firmness of end portions of the fillers of successive cigarettes 79 and 81 and generates signals denoting the detection of defective cigarettes. Such signals are used for segregation of the respective defective cigarettes, preferably at the same location and by the same means as used for segregation of cigarettes 79 and/or 81 which are found to be defective during travel in the flutes of the testing conveyor 74. Reference may be had to commonly owned U.S. Pat. No. 3,951,267 granted April 20, 1976 to Reuland. The testing conveyor 76 delivers satisfactory cigarettes 79 and 81 onto the upper reach of an endless belt-shaped take-off conveyor 77 which delivers the satisfactory plain cigarettes of unit length into storage, to a packing machine or to a filter tipping machine, e.g., a machine of the type disclosed in the aforementioned commonly owned U.S. Pat. No. 4,177,670.

Figure 3:
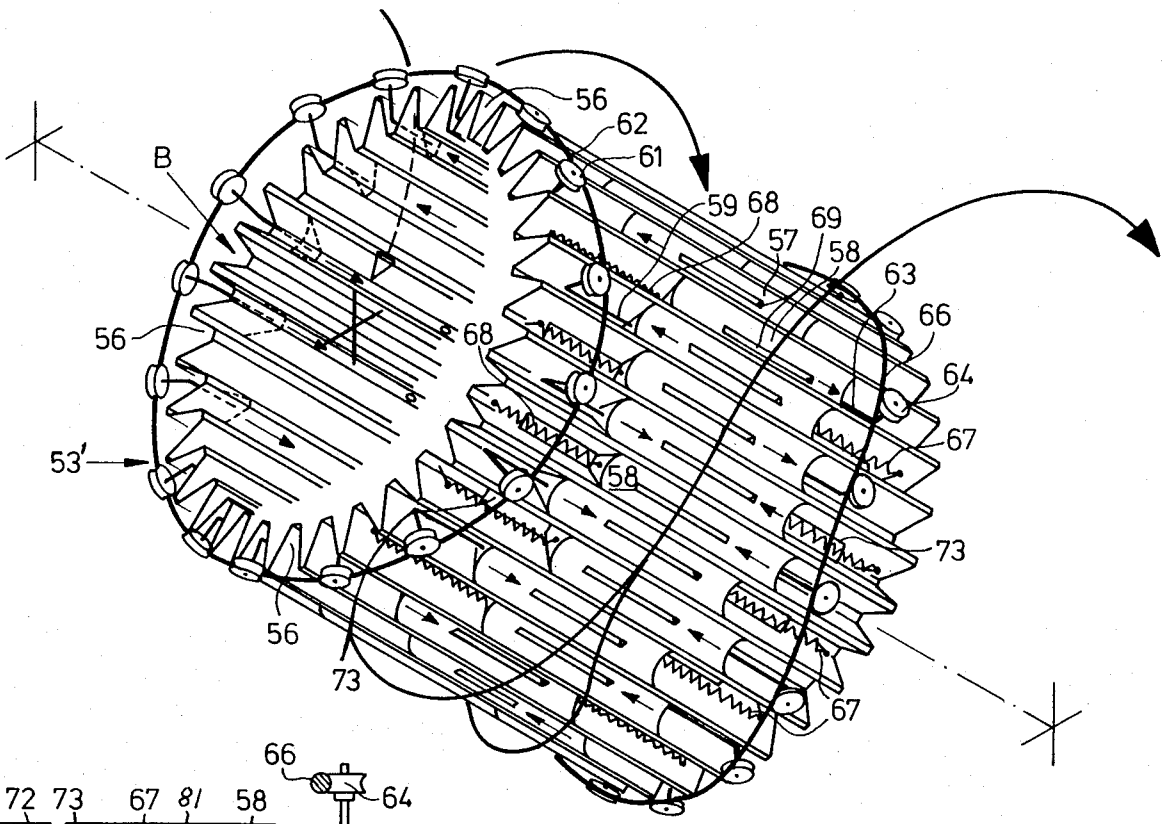
FIG. 3 is a perspective view of a shuffling device which can be used in the apparatus of the present invention.
Figure 4:
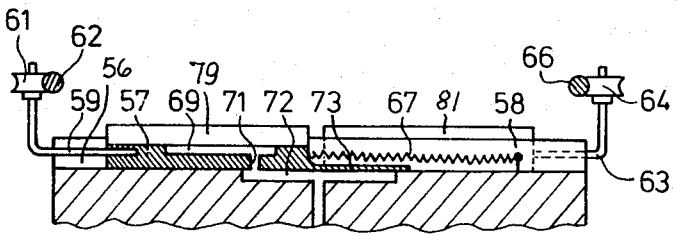
FIG. 4 is a fragmentary axial sectional view of the shuffling device which is shown in FIG. 3.

A modified shuffling conveyor 53' is shown in FIGS. 3 and 4. This conveyor comprises a rotary drum-shaped body whose periphery is provided with axially parallel recesses or grooves 56 each of which contains a reciprocable fluted article receiving device 57 or 58. The receiving devices 57 and 58 alternate with each other, as considered in the circumferential direction of the conveyor 53', and they are reciprocable in the longitudinal direction of the respective grooves 56, i.e., in parallelism with the axis of the conveyor 53'. The receiving devices 57 are biased by coil springs 67 or other suitable resilient means away from the left-hand end portion of the shuffling conveyor 53', as viewed in FIG. 4. Analogous coil springs 68 are provided to bias the receiving devices 58 away from the right-hand end portion of the shuffling conveyor 53', again as viewed in FIG. 4. The coil springs 67 and 68 form part of means for moving the receiving devices 57, 58 toward and away from the center of the shuffling conveyor 53', and such moving means further comprises a system of cams and followers shown in FIG. 4. Each receiving device 57 has an extension or arm 59 which carries a roller follower 61 tracking the respective side of an arcuate stationary cam 62 which can cause successive receiving devices 57 to move from the center toward the respective end portions of the corresponding groove 56 against the opposition of the associated springs 67. Analogously, the receiving devices 58 have arms 63 which carry roller followers 64 cooperating with a stationary arcuate cam 66 serving to move successive receiving devices 58 away from the centers and toward the right-hand end portions of the corresponding grooves 56 in response to rotation of the shuffling conveyor 53'. The moving means 59, 61-64, 66-68 is simple, reliable and inexpensive. It is responsive to rotation of the conveyor 53' about its own axis, i.e., each of the receiving devices 57, 58 moves once from its one to its other end position and back to the one end position during each revolution of the conveyor 53'.

The section of FIG. 4 is taken at the transfer station B, i.e., at the station where the receiving devices 57 and 58 respectively accept plain cigarettes 79, 81 of unit length from the components 51, 52 of the staggering conveyor 49 shown in FIG. 2. At such time, the respective receiving device 57 is adjacent to the left-hand end portion and the respective receiving device 58 is adjacent to the right-hand end portion of the shuffling conveyor 53', i.e., two neighboring receiving devices 57, 58 are located at a maximum distance from one another and from the central portions of the respective grooves 56. This is effected by the respective cams 62, 66 which hold the corresponding receiving devices 57, 58 against movement under the action of the respective coil springs 67 and 68 which permanently tend to move the corresponding receiving devices toward the centers of the corresponding grooves 56. The receiving device 57 of FIG. 4 is ready to accept or is in the process of accepting a cigarette 79 from the component 51, and the receiving device 58 of FIG. 4 is ready to accept or is in the process of accepting a cigarette 81 from the component 52 of the staggering conveyor 49.

The means for attracting the cigarettes 79 and 81 to the respective receiving devices 57, 58 comprises a suction generating device which communicates with suction ports or slots 69 machined into the receiving devices. Each port or slot 69 communicates with a discrete suction channel 72 in the drum-shaped body of the shuffling conveyor 53' by way of a port 71, and each channel 72 communicates with the aforementioned suction generating device (e.g., a pump or fan), in a manner which is not specifically shown in the drawing, during that portion of each revolution of the shuffling conveyor 53' when a cigarette 79 or 81 is to be attracted to the respective receiving device 57 or 58, i.e., during transport of such cigarettes from the station B to the station C. The dimensions of each channel 72 are selected in such a way that it can communicate with the corresponding slot 69 while the corresponding receiving device 57 or 58 moves from its outer end position (shown in FIG. 4) to its inner end position in the central portion of the respective groove 56. Each of the receiving devices 57, 58 is provided with or connected to a sealing element or shroud 73 which overlies a portion of the respective suction channel 72 (see FIG. 4) so as to prevent uncontrolled flow of air into the channel 72 and excessive reduction of the pressure differential between the interior of the channel 72 and the surrounding atmosphere. The sealing elements 73 begin to overlie the respective suction channels 72 as soon as the corresponding receiving devices 57, 58 leave their innermost positions in the central portions of the respective grooves 56.

The operation of the improved apparatus is as follows:

The continuous cigarette rod 28 which is formed in the machine of FIG. 1 is severed by the cutoff 31 so that it yields a file of sections or cigarettes 32 of double unit length. Each cigarette 32 of double unit length is formed with two imprints (shown at 78 in FIG. 2) whose mutual spacing matches the length of a cigarette (79 or 81) of unit length. Such imprints are applied to the web 21 at uniform intervals prior to draping of the web around the filler of the rod 28.

The cigarettes 32 of double unit length can be caused to change the direction of their movement from axial to sidewise by the transfer device 34 of FIG. 1 or in a manner as shown in FIG. 2, i.e., by being propelled seriatim into successive flutes of the drum-shaped row forming conveyor 42. If the transfer takes place in a manner as shown in the upper right-hand portion of FIG. 2, the conveyor 42 delivers successive cigarettes 32 of double unit length into successive flutes of the severing conveyor 44 which advances the cigarettes 32 past the knife 47 so that each cigarette 32 yields two initially coaxial plain cigarettes 79, 81 of unit length. Successive cigarettes 79 are transferred into successive flutes of the component 51, and successive cigarettes 81 are transferred into successive flutes of the component 52 of the staggering conveyor 49. Staggering of cigarettes 79 with reference to the cigarettes 81 takes place during transport of such cigarettes from the transfer station A to the transfer station B of FIG. 2. Thus, each cigarette 79 which reaches the transfer station B between the component 51 of the staggering drum 49 and the shuffling conveyor 53 or 53' is offset with reference to the corresponding cigarette 81 to such an extent that (with reference to the conveyor 53') successive cigarettes 79 at the station B can enter the receiving devices 57 in successive evenly numbered grooves 56 and successive cigarettes 81 arriving at the station B can enter the receiving devices 58 in successive oddly numbered grooves 56 of the shuffling conveyor 53'. Thus, each groove 56 of the shuffling conveyor 53' contains a single cigarette 79 or 81. During transfer of cigarettes 79, 81 at the station B, the cams 62 and 66 maintain the respective receiving devices 57, 58 close to the respective axial ends of the conveyor 53', i.e., in optimum positions for reception of cigarettes 79, 81 from the oncoming flutes of the respective components 51, 52 of the staggering conveyor 49. The springs 67, 68 for the receiving devices 57, 58 at the station B store energy and are ready to pull the respective receiving devices toward the central portions of the corresponding grooves 56 as soon as permitted to do so by the respective arcuate cams 62, 66 in response to further rotation of the conveyor 53'. The receiving devices 57, 58 convert the two rows of cigarettes 79, 81 into a single row wherein the cigarettes 79 alternate with the cigarettes 81 not later than at the transfer station C where the conveyor 53' delivers successive cigarettes of unit length into successive flutes of the first testing conveyor 74. As mentioned above, the conveyor 74 can form part of a testing unit which monitors the wrappers of successive cigarettes 79, 81 of unit length and generates signals denoting defective cigarettes. The second testing conveyor 76 can form part of a second testing unit which monitors another characteristic of each cigarette 79, 81 in its flutes, e.g., the density of the ends of fillers in such cigarettes. The ejection of defective cigarettes 79, 81 can take place during travel with the conveyor 76, e.g., by resort to a nozzle-like ejector arranged to discharge a jet of compressed gaseous medium whenever a defective cigarette 79, 81 advances into register with its nozzle. Reference may be had to the aforementioned commonly owned U.S. Pat. No. 4,177,670 to Heitmann et al.

If the apparatus of the present invention employs the shuffling conveyor 53 of FIG. 2, the cigarettes 79 and 81 are shuffled during travel between the transfer stations B and C as a result of movement along the respective stationary cams 55' and 55 so that they form a single row not later than at the station C, and such single row comprises alternating cigarettes 79 and 81. The conveyor 53 is simpler than the conveyor 53' but the latter is less likely to deface the ends of cigarettes during transport from the station B to the station C.

It is further possible to resort to other types of shuffling conveyors, for example, conveyors which employ suction ports or ports for discharge of compressed air. Reference may be had to commonly owned U.S. Pats. Nos. 3,685,633 and 3,812,950 respectively granted August 22, 1972 and May 28, 1974 to Rudszinat et al. which disclose such types of shuffling devices. It is presently preferred to employ a shuffling device of the type shown in FIGS. 3 and 4 because it is believed to be least likely to deface and/or otherwise affect the appearance and/or quality of the shuffled rod-shaped articles, especially when the articles are to be shuffled at a high or very high speed. Direct engagement between rapidly moving cigarettes and stationary cams (such as 55 and 55' shown in FIG. 2), propulsion of cigarettes by jets of compressed air, or shifting of cigarettes by suction is more likely to subject the cigarettes to pronounced mechanical stresses than the insertion into receiving devices 57, 58 of the shuffling conveyor 53' and attraction of cigarettes 79, 81 to the respective receiving devices by suction in a manner as described above in connection with FIG. 4.

The disclosures of all patents mentioned herein are incorporated by reference.

Figure 5:
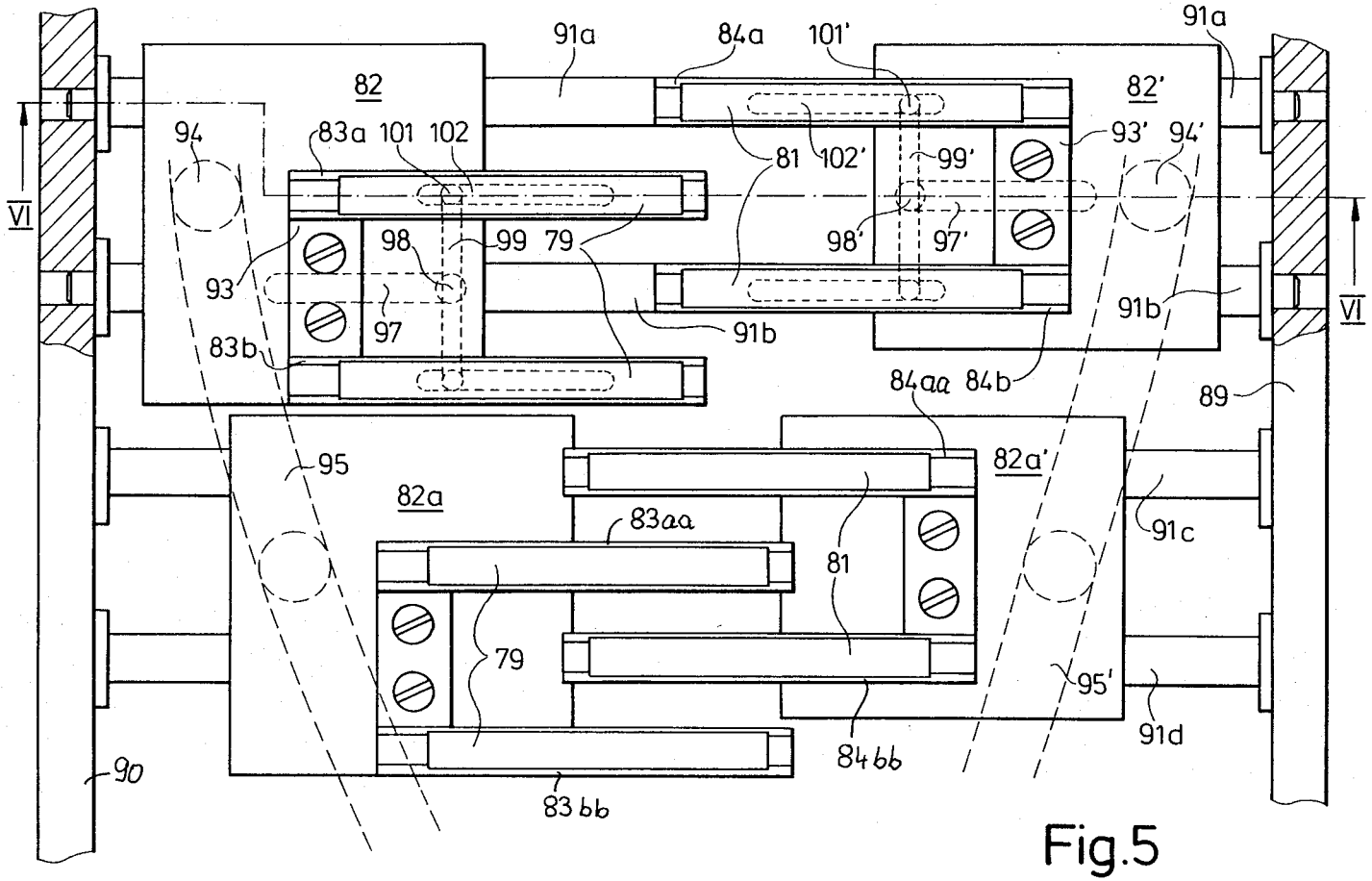
FIG. 5 is a fragmentary developed view of a modified shuffling device.
Figure 6:
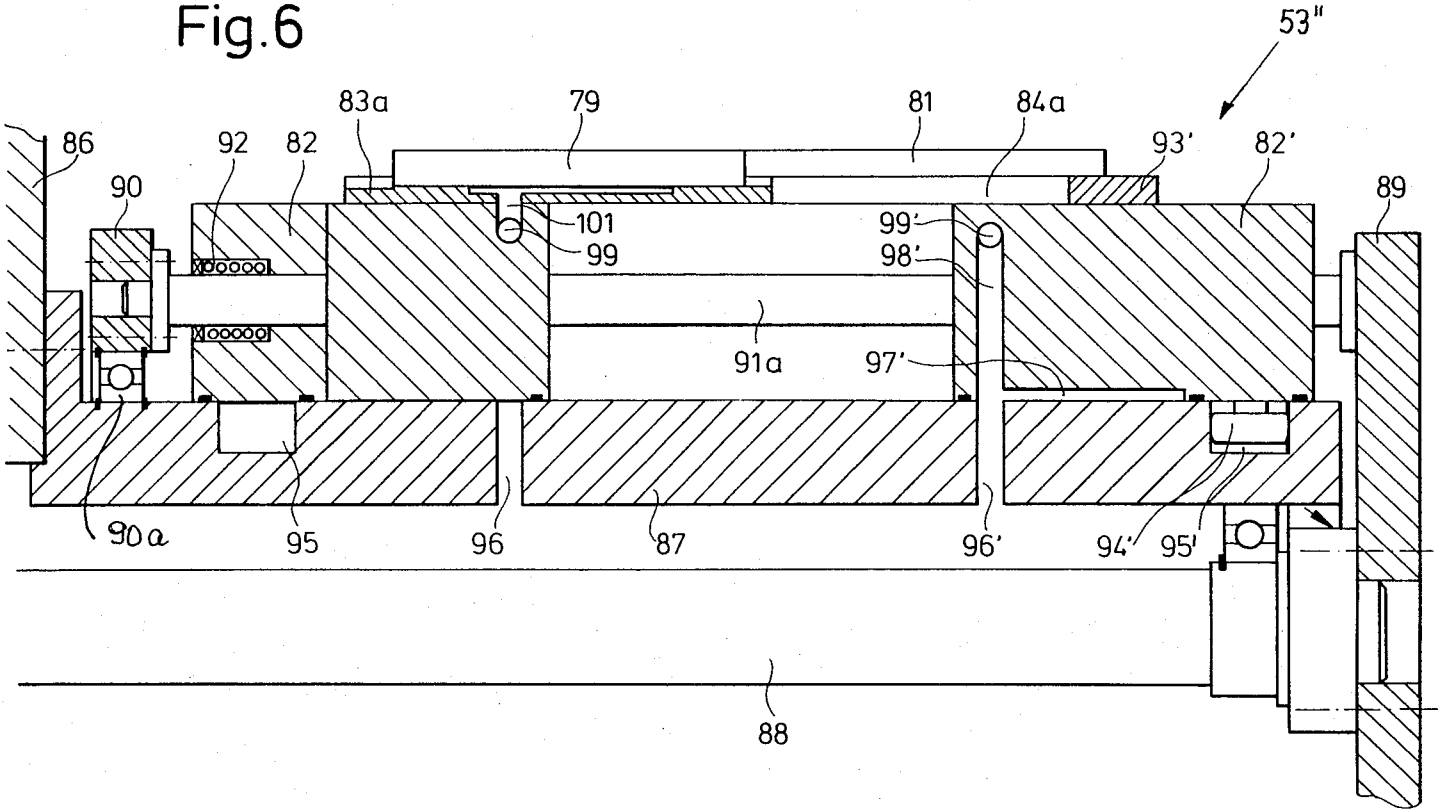
FIG. 6 is a sectional view as seen in the direction of arrows from the line VI—VI of FIG. 5.

Another embodiment of a shuffling conveyor (designated by the reference character 53'') which can be used in the apparatus of the present invention is shown in FIGS. 5 and 6. The frame 86 of the rod making machine carries a hollow cylindrical support 87 which is nonrotatably secured to the frame and surrounds a horizontal drive shaft 88 serving to transmit torque to the shuffling conveyor 53''. The right-hand end portion of the shaft 88, as viewed in FIG. 6, carries and transmits torque to a disc 89. That portion of the support 87 which is adjacent to the right-hand side of the frame 86 is surrounded by a ring 90 which is rotatable on an antifriction ball bearing **90*a* and supports the respective end portions of a series of parallel rod-like guide members or tie rods 91*a*, 91*b*, 91*c*, 91*d*, etc. The other end portions of the tie rods 91*a*, etc. are mounted in the disc 89 so that these tie rods together constitute an endless cage-like conveyor which surrounds and is rotatable relative to the support 87. The tie rods are equidistant from one another, as considered in the circumferential direction of the support 87. The axes of the tie rods are parallel to the axis of the shaft 88**.

The tie rods **91*a*-91*b* slidably support carriers or slides 82, 82', the tie rods 91*c*-91*d* slidably support carriers or slides 82*a'*, 82*a*, and so forth, i.e., each pair of neighboring tie rods supports two reciprocable carriers which are movable toward and away from each other. This can be readily seen in FIG. 5 wherein the carriers 82*a*, 82*a'* on the tie rods 91*c*, 91*d* are nearer to each other than the carriers 82, 82' on the tie rods 91*a*, 91*b*. The carriers are movable on suitable antifr:ction bearings 92, e.g., bearings of the type comprising several annuli of spherical rolling elements which surround the peripheral surfaces of the respective tie rods. The carrier 82 supports two fluted parallel cigarette receiving devices 83***a*, 83*b*, and the carrier 82' supports two fluted parallel cigarette receiving devices 84*a*, 84*b* which are parallel to the axis of the conveyor including the tie rods, the ring 90 and the disc 89, and which are also parallel to the receiving devices 83*a*, 83*b*. Analogously, the carrier 82*a* supports two parallel cigarette receiving devices 83*aa*, 83*bb*, and the carrier 82*a'* supports two parallel cigarette receiving devices 84*aa*, 84*bb*. The receiving devices 83*a*, 83*b* are staggered with reference to the receiving devices 84*a*, 84*b*, as considered in the circumferential direction of the support 87, by a distance which at least equals the width of a cigarette receiving device. The same holds true for the cigarette receiving devices 83*aa*, 83*bb* and 84*aa*, 84*bb*. This renders it possible to move the receiving devices 83*a*, 83*b*, 83*aa*, 83*bb* in a direction from the ring 90 toward the disc 89, and to move the receiving devices 84*a*, 84*b*, 84*aa*, 84*bb* in a direction from the disc 89 toward the ring 90 so that the cigarettes 79 in the left-hand receiving devices of FIG. 5 are aligned and alternate with the cigarettes 81 in the right-hand receiving devices of FIG. 5 when the respective carriers 82-82', 82*a*-82*a'*, etc. are moved sufficiently close to each other, i.e., close to the center of the conveyor including the ring 90 and the disc 89. When two aligned carriers (such as 82 and 82') are disposed at a maximum distance from one another, as considered in the axial direction of the support 87, their receiving devices are ready to accept cigarettes 79 and 81 from the respective components 51, 52 of the staggering conveyor 49 shown in FIG. 2 or from analogous staggering means. When two aligned carriers are moved nearest to each other, the cigarettes 79 and 81 which are held in the receiving devices of such carriers form a single row wherein the cigarettes 79 alternate with the ciagarettes 81, and such row is ready to be transferred from the shuffling conveyor 53'', e.g., into the flutes of the testing conveyor 74 shown in FIG. 2.

The receiving devices 83*a*, 83*b* of the carrier 82 are rigidly connected to each other by a bridge member 93. A similar bridge member 93' connects the receiving devices 84*a*, 84*b* on the carrier 82'. The bridge members for the receiving devices on the carriers 82*a*, 82*a'* are shown but not referenced. The distance between the receiving devices on any of the carriers equals the distance between alternate flutes of the conveyor which receives the single row of shuffled cigarettes 79, 81 from the conveyor 53'' of FIGS. 5 and 6. Such distance is twice the distance between two neighboring receiving devices (e.g., the devices 84*a*, 83*a* or 83*a*, 84*b*, or 84*b* 83*b*, and so forth). Thus, when the cigarettes 79, 81 on the conveyor 53'' are shuffled, they form a single row of parallel equidistant cigarettes with a mutual spacing corresponding to that between the neighboring flutes of the conveyor which is to receive the single row of shuffled cigarettes 79, 81 from the conveyor 53''.

FIG. 6 shows that the carriers 82, 82', etc. slide along the peripheral surface of the stationary support 87. Those portions of the carriers which are adjacent to the support 87 carry followers in the form of idler rollers rotatable about axes extending radially of the support 87. The roller followers 94 are provided on the left-hand carriers 82, 82*a*, etc. of FIGS. 4–5, and the roller followers 94' are provided on the right-hand carriers 82', 82*a'*, etc. The roller followers 94 extend into an endless cam groove 95, and the roller followers 94' extend into an endless cam groove 95' which is mirror symmetrical to the cam groove 95 with reference to a plane extending at right angles to the axis of the shaft 88 and disposed at least substantially midway between the disc 89 and ring 90. The cam grooves 95, 95' are machined into the peripheral surface of the support 87 and the surfaces of such cam grooves, together with the roller followers 94 and 94', constitute the means for moving the carriers 82, 82', etc. toward or away from each other during certain stages of each revolution of the conveyor including the tie rods 91*a*, etc., the disc 89 and the ring 90.

It has been found that the shuffling conveyor 53'' also permits for gentle treatment of cigarettes 79, 81 during shuffling for the purpose of converting two rows of such cigarettes into a single row wherein the cigarettes 79 alternate with the cigarettes 81 and the cigarettes are ready to be transferred from the conveyor 53'' onto the conveyor 74 or onto a different conveyor having flutes or other suitable receiving means for the cigarettes 79 and 81 of the single row.

The means for attracting the cigarettes 79 and 81 to the respective receiving devices of the shuffling conveyor 53'' includes a suction generating device (e.g., a pump or a blower) whose intake is connected with the grooves 102 of the left-hand receiving devices 83*a*, 83*b*, etc. and with the grooves 102' of the right-hand receiving devices 84*a*, 84*b*, etc. during those stages of angular movement of the receiving devices when they carry cigarettes 79 and 81 from the staggering conveyor to the testing conveyor 74. The grooves 102, 102' respectively communicate with radially extending ports 101, 101' which, in turn, respectively communicate with circumferentially extending bores 99, 99'. The bores 99, 99' respectively communicate with radially extending bores 98, 98' which, in turn respectively communicate with axially parallel grooves 97, 97' in the undersides of the respective left-hand and right-hand carriers. The grooves 97, 97' respectively communicate with radial bores 96, 96' machined into the support 87 and communicating with the intake of the suction generating device.

If the cutoff 31 of the machine shown in FIG. 1 is designed to sever from the rod 28 cigarettes of unit length, the apparatus of the present invention is designed in a manner as shown in the left-hand portion of FIG. 1. Thus, each arm 33 of the transfer device 34 accepts and transfers a group of two coaxial cigarettes 79, 81 (or 32A, 32B, see the upper right-hand portion of FIG. 2 wherein pairs of cigarettes 32A, 32B of unit length together constitute successive cigarettes 32 of double unit length), and such groups of cigarettes 79, 81 (or 32A, 32B) are deposited in successive axially parallel peripheral flutes of the row forming conveyor 36. The latter transfers such pairs of cigarettes onto a staggering conveyor 149 which can be identical with or analogous to the conveyor 49 of FIG. 2, and the staggering conveyor 149 transfers the two rows of cigarettes of unit length onto a shuffling conveyor 153, e.g., a conveyor of the type shown in FIGS. 3–4 or in FIGS. 5–6. Thus, if the cutoff 31 is designed to subdivide the leader of the rod 28 into a file of cigarettes (79, 81 or 32A, 32B) of unit length, the severing conveyor 44 and the knife 47 of FIG. 2 can be dispensed with.

It is also possible to resort to the accelerating cam 42A of FIG. 2 and to the row forming conveyor 42 of FIG. 2 even if the cutoff 31 subdivides the leader of the rod 28 into cigarettes (32A, 32B) of unit length. The lobes of the cam 42A are distributed in such a way, or the cam 42A is driven at such a speed, that successive lobes engage and accelerate each second cigarette (32B) of the single file of cigarettes advancing beyond the cutoff 31 so that each flute of the conveyor 42 receives two coaxial cigarettes 32A, 32B. The conveyor 42 then delivers pairs of coaxial cigarettes 32A, 32B directly to the staggering conveyor 49. Once the cigarettes 32A, 32B reach the staggering conveyor 49 (which can receive such cigarettes directly from the row forming conveyor 42 or by way of one or more intermediate conveyors, not shown), the cigarettes 32A, 32B are processed in the same way as described in connection with the cigarettes 79 and 81.

An important advantage of the improved method and apparatus is that the articles are treated gently and that the articles can be produced and processed at a rate which is required in connection with modern high-speed cigarette rod makers and like machines. The output of the improved apparatus is higher than that of heretofore known apparatus irrespective of whether the improved apparatus is designed to accept and manipulate sections (such as 32) of multiple unit length or to accept and manipulate sections (79, 81 or 32A, 32B) of unit length. Practically all conventional cigarette rod makers are designed to form a single file of cigarettes of unit length.

Another important advantage of the improved apparatus is that it need not employ a turn around device which is indispensable in practically all heretofore known and presently used machines for the conversion of several rows of cigarettes of unit length into a single row. As mentioned above, tip turning subjects the cigarettes to pronounced mechanical stresses with attendant danger of deformation of cigarettes, escape of tobacco at the ends and/or other undesirable consequences. As also mentioned above, it is possible to select any one of several types of shuffling means each of which exhibits certain advantages and certain drawbacks but of which the shuffling means shown in FIGS. 3–4 and 5–6 are preferred at this time.

A further important advantage of the improved apparatus is that it is relatively simple, compact and inexpensive in spite of its high output and its ability to treat the articles gently, even while being operated at a maximum speed. Moreover, the apparatus can employ several conventional components, such as several of the aforementioned shuffling devices, row forming conveyors, accelerating means, cutoffs and/or others. The shuffling means of FIGS. 3–4 and 5–6 (whichever happens to be used in the improved apparatus) are also simple, compact, relatively inexpensive, reliable, not prone to pronounced wear and thus capable of long periods of uninterrupted use.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of producing plain cigarettes of unit length or analogous rod-shaped articles which constitute or form part of smokers' products, comprising the steps of forming a continuous rod including draping a web of wrapping material around a rod-like filler; advancing the rod axially; subdividing the advancing rod into a file of coaxial sections of n times unit length wherein n is a whole number including one; converting the file into a plurality of rows of parallel sections and advancing said rows so that their sections move sideways; and shuffling the sections of said rows so as to convert the rows into a single row of parallel sections, including moving the sections of at least one of said plurality of rows axially.

2. The method of claim 1, further comprising the step of staggering the sections of said rows with reference to each other, as considered at right angles to the axes of the sections, prior to said shuffling step so that the staggered sections of said rows are out of axial alignment with one another.

3. Apparatus for producing plain cigarretes of unit length or analogous rod-shaped articles which constitue or form part of smokers' products, comprising means for forming a continuous rod wherein a rod-like filler is surrounded by a web of wrapping material; means for moving the rod axially; means for subdividing the rod into a file of coaxial sections of n times unit length wherein n is a whole number including one; means for converting the file of sections into several rows of parallel sections and for moving said rows along predetermined paths wherein the sections extend substantially at right angles to the direction of movement of the respective rows; and means for shuffling the sections of said rows so as to convert the rows into a single row of parallel sections, including means for moving the sections of at least one of said rows axially.

4. The apparatus of claim 3, wherein said converting means comprises means for maintaining each section of one of said several rows in a position of axial alignment with a section of each other row and further comprising means for staggering the sections of said several rows so that each section of any one of said several rows is out of axial alignment with the sections of each other row prior to shuffling of said rows of sections by said shuffling means.

5. A method of producing plain cigarettes of unit length or analogous rod-shaped articles which constitute or form part of smokers' products, comprising the steps of forming a continuous rod including draping a web of wrapping material around a rod-like filler; advancing the rod axially; subdividing the advancing rod into a file of coaxial sections of n times unit length wherein n is a whole number exceeding one; converting the file into a plurality of rows of parallel sections and advancing said rows so that their sections move sideways, said converting step comprising changing the direction of movement of the sections of said file from axial to sidewise movement so that the sections form a single row of parallel sections of multiple unit length which move sideways, subdividing the sections of multiple unit length in said single row into articles of unit length so that the single row of sectional of multiple unit length yields n rows of articles of unit length wherein each articles of one of said n rows is in axial alignment with one article of each other row, and staggering the articles of said n rows so that the articles of any one of said n rows are out of axial alignment with the articles of each other row of said n rows; and shuffling the artilces of said n rows so as to convert the n rows into a single row of parallel articles.

6. The method of claim 5, wherein n equals two.

7. A method of producing plain cigarettes of unit length or analogous rod-shaped articles which consitutes or form part of smokers' products, comprising the steps of forming a continuous rod including draping a web of wrapping material around a rod-like filler; advancing the rod axially; subdividing the advancing rod into a file of coaxial sections of unit length; converting the file into a plurality of rows of parallel sections and advancing said rows so that their sections move sideways, said converting step comprising substantially simultaneously changing the direction of advancement of successive groups of m sections of said file so that the groups of sections form m rows of parallel sections and moving the sections of said m rows sideways so that each section of one of said m rows is in axial aligment with a section of each other row, and staggering the sections of said m rows relative to each other so that the sections of any one of said m rows are out of axial alignment with the sections of the other rows; and shuffling the sections of said rows so as to convert the rows into a single row of parallel sections.

8. The method of claim 7, wherein m equals two.

9. A method of producing plain cigarettes of unit length or analogous rod-shaped articles which constitute or form part of smokers' products, comprising the steps of forming a continuous rod including draping a web of wrapping material around a rod-like filler; advancing the rod axially; subdividing the advancing rod into a file of coaxial sections of n times unit length wherein n is a whole number including one; converting the file into a plurality of rows of parallel sections and advancing said rows so that their sections move sideways; shuffling the sections of said rows so as to convert the rows into a single row of parallel sections; and applying to the web of wrapping material indicia at intervals corresponding to the length of an article of unit length.

10. The method of claim 9, wherein said indicia applying step precedes the drapping of the web around the filler.

11. Apparatus for producing plain cigarettes of unit length or analogous rod-shaped articles which constitute or form part of smokers' products, comprising means for forming a continuous rod wherein a rod-like filler is surrounded by a web of wrapping material; means for moving the rod axially; means for subdividing the rod into a file of coaxial sections of multiple unit length; means for converting the file of sections into several rows of parallel sections and for moving said rows along predetermined paths wherein the sections extend substantially at right angles to the direction of movement of the respective rows, said converting means comprising means for changing the direction of movement of sections of multiple unit length so that the sections form a single row of sections of multiple unit length, means for severing the sections of the single row of sections of multiple unit length so that each such section yields n coaxial articles of unit length and the articles of unit length form n rows of parallel articles wherein each article of one of said rows is in axial alignment with an article of each other row, and means for staggering the articles of each of said n rows with reference to the articles of each other row; and means for shuffling the articles of said rows so as to convert the rows into a single row of parallel articles.

12. The apparatus of claim 11, wherein n equals two.

13. Apparatus for producing plain cigarettes of unit length or analogous rod-shaped articles which constitute or form part of smokers' products, comprising means for forming a continuous rod wherein a rod-like filler is surrounded by a web of wrapping material; means for moving the rod axially; means for subdividing the rod into a file of coaxial sections of unit length; means for converting the file of sections into several rows of parallel sections and for moving said rows along predetermined paths wherein the sections extend substantially at right angles to the direction of movement of the respective rows, said converting means comprising means for changing the direction of movement of successive groups of m sections from axial to sidewise movement so that such groups form m rows of parallel sections wherein each section of one of said m rows is in axial alignment with one section of each other row, and means for staggering each section of one of said m rows with reference to each section of each other row; and means for shuffling the sections of said m rows so as to convert such rows into a single row of parallel sections.

14. Apparatus for producing plain cigarettes of unit length or analogous rod-shaped articles which constitute or form part of smokers' products, comprising means for forming a continuous rod wherein a rod-like filler is surrounded by a web of wrapping material; means for imprinting indicia upon the web of wrapping material at intervals corresponding to the length of an article of unit length; means for moving the rod axially; means for subdividing the rod into a file of coaxial sections of n times unit length wherein n is a whole number including one; means for converting the file of sections into several rows of parallel sections and for moving said rows along predetermined paths wherein the sections extend substantially at right angles to the direction of movement of the respective rows; and means for shuffling the sections of said rows so as to convert the rows into a single row of parallel sections.

15. Apparatus for producing plain cigarettes of unit length or analogous rod-shaped articles which constitute or form part of smokers' products, comprising means for forming a continuous rod wherein a rod-like filler is surrounded by a web of wrapping material; means for moving the rod axially; means for subdividing the rod into a file of coaxial sections of n times unit length wherein n is a whole number including one; means for converting the file of sections into several rows of parallel sections and for moving said rows along predetermined paths wherein the sections extend substantially at right angles to the direction of movement of the respective rows; and means for shuffling the sections of said rows so as to convert the rows into a single row of parallel sections, comprising an endless conveyor having several sets of article receiving means, one set for each of said several rows, and means for moving the receiving means of at least one of said sets in the axial direction of the articles therein.

16. The apparatus of claim 15, wherein said conveyor comprises a rotary drum, said receiving means being disposed at the periphery of said drum and the receiving means of said at least one set being movable in parallelism with the axis of said drum.

17. The apparatus of claim 16, wherein said drum has axially parallel peripheral recesses, one for each of said receiving means, said moving means comprising means for shifting the receiving means of said at least one set in the respective recesses from one axial end toward the center of said drum.

18. The apparatus of claim 17, wherein the number of said sets equals two and the receiving means of said one set alternate with the receiving means of the other of said sets, and further comprising means for moving the receiving means of said other set from the other axial end toward the center of said drum and vice versa.

19. The apparatus of claim 17, wherein said moving means comprises cam means.

20. Apparatus for producing plain cigarettes of unit length or analogous rod-shaped articles which constitute or form part of smokers' products, comprising means for forming a continuous rod wherein a rod-like filler is surrounded by a web of wrapping material; means for moving the rod axially; means for subdividing the rod into a file of coaxial sections of n times unit length wherein n is a whole number including one; means for converting the file of sections into several rows of parallel sections and for moving said rows along predetermined paths wherein the sections extend substantially at right angles to the direction of movement of the respective rows; and means for shuffling the sections of said rows so as to convert the rows into a single row of parallel sections, comprising an endless conveyor, several sets of carriers provided on said conveyor, at least two article receiving means provided on each of said carriers, and means for moving the carriers of at least one of said sets with reference to the carriers of each other set in the axial direction of the sections in said receiving means.

21. The apparatus of claim 20, wherein said sets include a first and a second set of carriers and the receiving means on the carriers of said first set are staggered with reference to the receiving means on the carriers of said second set, as considered at right angles to the axes of sections in said receiving means, by a distance at least matching the width of a receiving means.

22. The apparatus of claim 21, wherein said moving means includes cam and follower means.

* * * * *